United States Patent [19]

Lafferty

[11] 4,128,748

[45] Dec. 5, 1978

[54] HIGH-CURRENT VACUUM SWITCH WITH REDUCED CONTACT EROSION

[75] Inventor: James M. Lafferty, Schenectady, N.Y.

[73] Assignee: General Electric Company, Schenectady, N.Y.

[21] Appl. No.: 867,986

[22] Filed: Jan. 9, 1978

Related U.S. Application Data

[63] Continuation-in-part of Ser. No. 707,297, Jul. 21, 1976, abandoned.

[51] Int. Cl.[2] ..... H01H 33/66

[52] U.S. Cl. ..... 200/144 B; 200/262; 200/267

[58] Field of Search ..... 200/144 B, 262, 263, 200/267

[56] References Cited

U.S. PATENT DOCUMENTS

| | | | |
|---|---|---|---|
| 2,897,322 | 7/1959 | Reece | 200/144 B |
| 3,082,307 | 3/1963 | Greenwood et al. | 200/144 B |
| 3,769,538 | 10/1973 | Harris | 200/144 B |
| 3,997,748 | 12/1976 | Harris | 200/144 B |

FOREIGN PATENT DOCUMENTS

| | | | |
|---|---|---|---|
| 787846 | 12/1957 | United Kingdom | 200/144 B |
| 839252 | 6/1960 | United Kingdom | 200/144 B |

*Primary Examiner*—Robert S. Macon

*Attorney, Agent, or Firm*—Nathan D. Herkamp; Joseph T. Cohen; Leo I. MaLossi

[57] ABSTRACT

In high-current vacuum switch devices wherein the arc must transfer from the contacts to auxiliary electrodes, excessive contact erosion can be avoided by making this transfer occur as quickly as possible. Rapid transfer is facilitated by fabricating the contacts of refractory metal and the auxiliary electrodes of a material that is easily vaporized, consistent with chopping and recovery requirements, such as copper or iron.

10 Claims, 5 Drawing Figures

HIGH-CURRENT VACUUM SWITCH WITH REDUCED CONTACT EROSION

INTRODUCTION

This is a continuation-in-part of application Ser. No. 707,297, filed July 21, 1976, now abandoned.

This invention relates to high-current vacuum arc discharge devices, and more particularly to a vacuum switch configuration for promoting rapid transfer of an arc away from the contacts of the vacuum switch to auxiliary electrodes therein.

In various types of high-current arc discharge devices wherein the arc must transfer from the contacts to auxiliary electrodes such as rods (as, for example, in J. A. Rich U.S. Pat. No. 3,854,078 issued Dec. 10, 1974 and assigned to the instant assignee) or paddle-wheel-fins (as, for example, in J. M. Lafferty U.S. Pat. No. 3,356,893, issued Dec. 5, 1967 and assigned to the instant assignee), it is desirable that a large fraction of the current be transferred from the contacts to the auxiliary electrodes as quickly as possible. This is to avoid excessive erosion of the contacts, which imposes a limitation on contact lifetime, Arcing across the contacts also causes contact metal to splatter onto the auxiliary electrodes. The rough surfaces thus produced reduce the hold-off voltage of the vacuum switch (i.e., the maximum voltage which can be withstood by the vacuum switch without reestablishing an arc while the contacts are fully open) and may additionally lead to formation of anode spots which result in further erosion of the anode electrodes and melting thereof. This may ultimately cause failure of the device.

An arc in a vacuum switch tends to burn in the area where it can most easily generate metal vapor. Therefore, to protect the contacts against excessive erosion by rapidly transferring the arc from the contacts to another location, it is important not only to open the contacts quickly, but also to use a contact material that does not easily vaporize during arcing. The present invention is directed to a high-current vacuum switch of this type.

Accordingly, one object of the invention is to provide a high-current vacuum switch in which the arc is transferred quickly from the contacts to auxiliary electrodes.

Another object is to provide a high-current vacuum switch exhibiting reduced contact erosion.

Another object is to provide a high current vacuum switch wherein hold-off voltage remains high for an increased number of contact openings therein.

Briefly, in accordance with a preferred embodiment of the invention, a vacuum arc discharge device comprises a hermetically sealed, evacuated envelope containing a pair of unshielded contact means disposed along the longitudinal axis of the device. At least one of the pair of contact means is mechanically coupled to a movable support so as to be capable of controllably making contact with, or separating from, the other of the pair of contact means. Both of the pair of contact means are exposed to high electric field intensity when separated from each other. Separated first and second pluralities of auxiliary electrodes are disposed along the longitudinal axis of the device for carrying the arc when the contact means are fully parted. An improved device results when each of the contact means consists essentially of a refractory metal and each of the auxiliary electrodes is comprised of easily-vaporizable metal.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
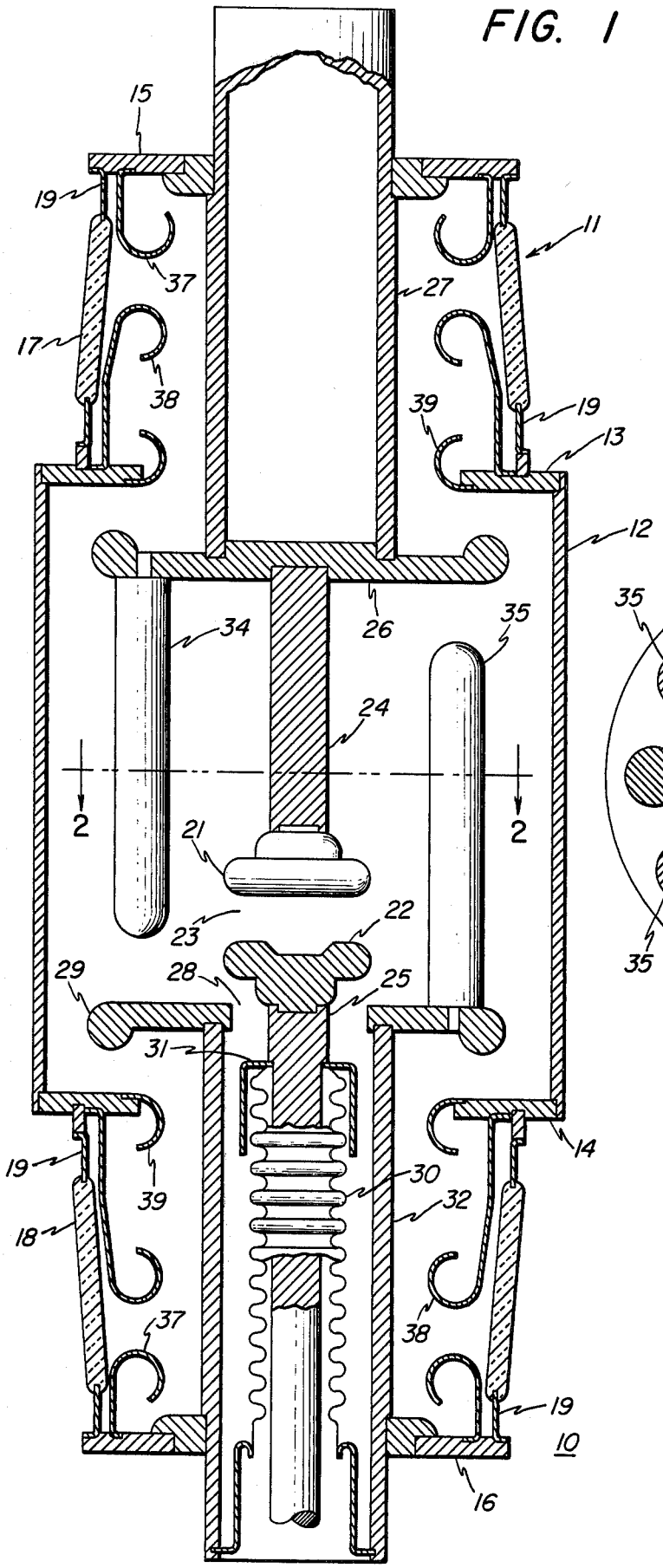
FIG. 1 is a longitudinal view, partially in section, of a vacuum switch that may be fabricated in accordance with the present invention.

FIG. 1 illustrates a vacuum arc discharge device 10, which comprises a vacuum switch type of circuit interrupter, employing the teachings of the invention. Thus vacuum switch 10 comprises an envelope 11, the interior of which is evacuated of gas. Envelope 11 includes a metallic sidewall member 12 which is hermetically sealed to upper and lower metallic flanges 13 and 14, respectively. Spaced apart from upper and lower flanges 13 and 14, respectively, are upper and lower endwalls 15 and 16, respectively. Insulating sidewall members 17 and 18 are hermetically sealed to respective upper and lower flanges 13 and 14 at one end and to upper and lower endwalls 15 and 16, respectively, at the other end, through metallic flanges 19 which are suitably affixed to flanges 13 and 14 and to endwalls 15 and 16.

Within envelope 11, a pair of unshielded contacts 21 and 22 which define an arcing gap 23 therebetween when in open-circuit position, are supported upon respective contact support members 24 and 25. "Unshielded" as used herein defines a structure for the central pair of butt contacts of a vacuum circuit breaker free of shielding in the region between the butt contacts and the auxiliary electrodes for protection against arcing currents or against electric stress at dielectric recovery and for prevention of accumulation of metal vapor on the butt contacts. Contact support member 24 is shown stationary and is electrically and mechanically affixed to a metallic support plate 26 which, in turn, is supported from upper endwall 15 by a metallic cylindrical support member 27. Contact support member 25 is reciprocally movable through an aperture 28 in a metallic support plate 29. Vacuum integrity within envelope 11, while permitting reciprocal mobility to contact support member 25, is maintained by a bellows assembly 30 affixed at a flange 31 to contact support member 25 and at its opposite end to a cylindrical support member 32. During steady-state current flow, current is carried through support member 27, support plate 26, contact support 24, contacts 21 and 22, and contact support 25. Metallic support member 32 provides the main current conduction path instead of contact support member 25 after the contacts have parted and the resulting arc has transferred away from the contacts.

Figure 2:
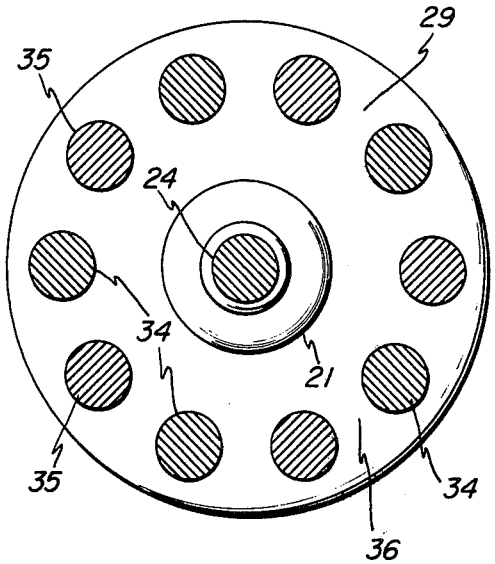
FIG. 2 is a horizontal sectional view taken along line 2—2 in FIG. 1.

A set of stationary, downwardly-extending auxiliary electrodes 34 is affixed to metallic support plate 26, and a set of stationary, upwardly-extending auxiliary electrodes 35 is affixed to metallic support plate 29. Electrodes 34 are entirely spaced apart from electodes 35. In the embodiment shown in FIG. 1, each of electrodes 34 and 35 is a smooth-surfaced cylindrical rod-like member, preferably of solid construction, though hollow construction may alternatively be employed. Each set of auxiliary electrodes is arranged in a circular array so that an interdigitated ring-shaped structure having a plurality of uniform interelectrode gaps 36 is formed by the alternation of downwardly-extending electrodes 34 and upwardly-extending electrodes 35, as illustrated in FIG. 2 which is a cross-sectional view taken along lines 2—2 of FIG. 1.

In vacuum arc discharges, since the arc tends to burn in the area where it can most easily generate metal vapor, the necessity for early transfer of the arc away from the contacts makes it important not only to open the contacts at high speed, but also to use a contact material that is not easily vaporized. To achieve this result, each of the contacts of the invention consists essentially of a refractory metal such as tungsten, molybdenum or tantalum. The auxiliary electrodes, on the other hand, are comprised of a material that is easily vaporized, consistent with current chopping requirements and recovery (i.e., vacuum restoration) time requirements, such as copper or iron.

In a vacuum switch wherein both of the contacts are exposed to the same electrical stresses, and with both contacts consisting essentially of the same refractory material, the teachings of the prior art would lead to the expectation that the arc discharge device of the present invention should suffer from reduced current-handling capacity. For example, in Lee et al. U.S. Pat. No. 2,975,256, issued Mar. 14, 1961 and assigned to the instant assignee, it is pointed out that the current interrupting capacity of vacuum switches employing refractory contacts is not as high as for comparable vacuum switches using contacts of other materials. The present invention avoids this infirmity, however, since the arc, once established between contacts 21 and 22 as they are parting, quickly transfers to the fixed gap between adjacent, stationary, secondary electrodes 34 and 35. Moreover, though the contacts are at least faced with like materials, contact welding presents little problem since the arc, on contact reclosing, is not initiated until just prior to the contacts again touching each other, leaving insufficient time for the arc to raise the contact temperature high enough to cause contact welding.

In M. P. Reece British Pat. No. 787,846, granted Dec. 18, 1957, a high-vacuum circuit breaker is described wherein each contact of a pair of subsidiary contacts of tungsten or molybdenum is encircled by a respective main contact of copper. Upon opening of the breaker, the main contacts are separated before the subsidiary contacts. Toward the end of the movement of the subsidiary contacts, each of the contact surfaces of the subsidiary contacts lies behind the general plane of the contact surface of the corresponding main electrode and is sufficiently close to it that any arc initiated at the subsidiary contact is transferred to the main contact. Similarly, in M. P. Reece British Pat. No. 839,252, granted June 29, 1960, a high-vacuum circuit breaker is described wherein each contact of a pair of main contacts of tungsten or molybdenum is encircled by a plurality of auxiliary electrodes of copper or iron. The auxiliary electrodes connected to one end of the breaker make contact with the auxiliary electrodes connected to the other end of the breaker. Upon opening of the breaker, the auxiliary electrodes are separated before the main contacts, producing arcing between cooperating auxiliary contact surfaces. Only after this arcing has ceased are the main contacts opened. Shielding provided about the main contacts and about the auxiliary electrodes serves to adsorb energy emitted on arcing and not traveling toward a contact surface of any auxiliary electrode, in order to reduce the risk of reignition over long paths in the envelope after a current zero.

Upon opening of the breakers described in each of the aforementioned Reece British patents, it is necessary to separate outer contact surfaces first, and thereafter separate the inner contact surfaces, thus introducing added delay before the protected circuit is interrupted. During this added delay, damage to the protected circuit may result. Additionally, the relatively high vapor pressure of the copper or iron electrodes supports concentrated arcs thereon, resulting in likelihood of damage to the contacts comprised of this material. The present invention avoids these problems.

In L. P. Harris application Ser. No. 589,516, filed June 23, 1975, now U.S. Pat. No. 3,997,748, issued Dec. 14, 1976, and assigned to the instant assignee, a vacuum switch employing a central pair of butt contacts surrounded by secondary electrodes in the form of rods, with the movable contact being retractable into a shield, is described. The moving contact is faced with molybdenum and the stationary contact is faced with steel, so as to provide high-current and voltage interruption capability with low contact erosion, low weld forces, and satisfactory current chopping performance. Use of the refractory metal in the moving contact of the Harris application is facilitated by the protection against high arcing currents late in the arcing period and against high electric stresses at dielectric recovery, afforded by the shield to the movable contact. In the present invention, no such contact shield is required or employed.

When an overload condition occurs in the apparatus shown in FIGS. 1 and 2, butt contacts 21 and 22 are separated by retraction of support member 25, and an arc is struck in gap 23. When butt contacts 21 and 22 are a sufficient distance apart, the arc transfers from contacts 21 and 22 to secondary electrodes 34 and 35. This transfer typically is initially achieved by suitably shaping the butt contacts so as to produce a magnetic field which drives the arc plasma outward from the longitudinal axis of the device. Once the arc is transferred to secondary electrodes 34 and 35, it burns there preferentially because of the substantially lower arc drop across the secondary electrodes relative to the arc voltage drop across butt contacts 21 and 22. This arc is diffuse, due to the interdigitation of the secondary electrodes.

The high current arcs caused by the overload current passing through the array of secondary electrode members are sustained by a conductive plasma comprising metal vaporized from electrodes 34 and 35. This plasma permits the arcs to transfer across gaps 36 in each parallel conductive path until the arcing current passes through zero amplitude and conduction ceases, giving the specie of the plasma an opportunity to cool and condense upon the relatively cool surface of metallic sidewall 12. When the next cycle of alternating voltage is applied across the open contacts, the high dielectric strength of the vacuum within the device prevents reestablishment of the current.

In the device of FIG. 1, metallic support plates 26 and 29 also provide shielding between the arcing region and insulating sidewall members 17 and 18. These support plates prevent molten metal particles and/or metal vapor emitted in the arcing region from adhering to the insulating sidewall members and producing electrical short-circuits. Additional shield members 37, 38 and 39, with large radii of curvature, provide additional shielding for the insulating sidewall members without undesirably reducing the voltage breakdown capability of the vacuum switch device. By using refractory materials for butt contacts 21 and 22, the high ultimate strength and low contact erosion thus obtained is advantageous. Employment of easily vaporizable metal secondary electrodes allows achievement of high current and voltage interruption capability with low contact erosion and satisfactory current chopping performance (i.e., avoidance of forcing the load current to zero abruptly and prematurely before a natural current zero is reached) at low cost.

Figure 3:
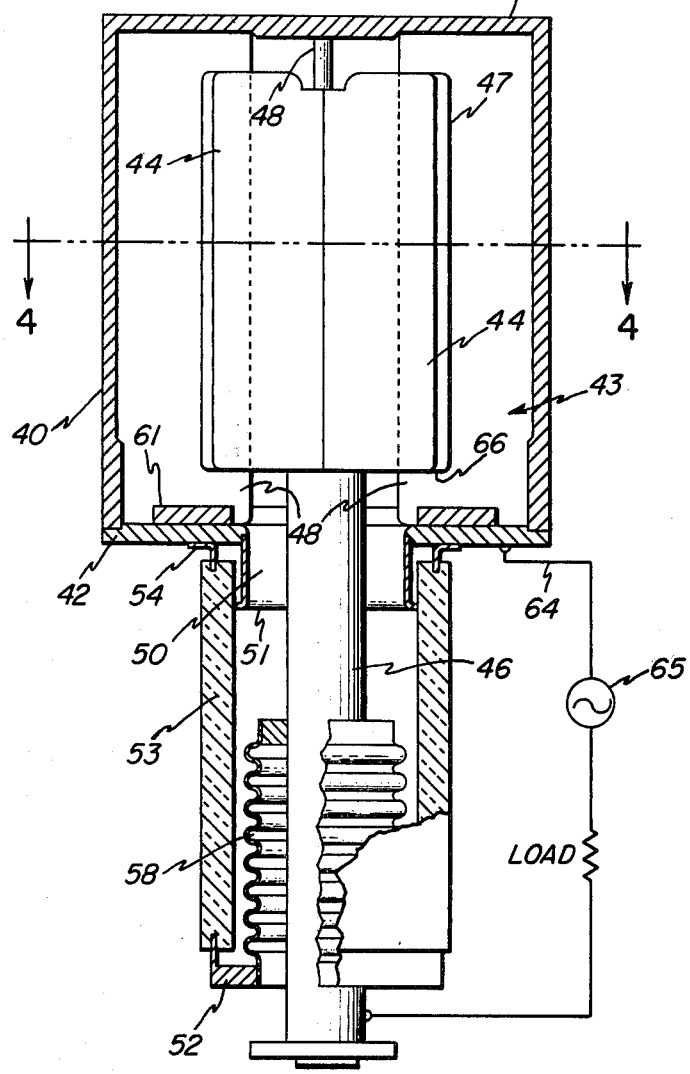
FIG. 3 is a longitudinal view, partially in section, of an alternative design of a vacuum switch that may be fabricated in accordance with the present invention.

In FIG. 3, another embodiment of a vacuum switch is shown in cross-section, with parts broken away. An envelope evacuated of gas comprises a generally cylindrical metallic sidewall 40, a closed upper endplate 41 and a lower apertured endplate 42. The aperture in endplate 42 is closed by a hermetic seal between an annular sealing flange member 54 and a ceramic insulating bushing 53. Bushing 53 is closed by an annular apertured endplate 52 which is hermetically sealed thereto and fastened to a longitudinally-flexible bellows 58 which is sealed hermetically to electrode support member 46 to complete a vacuum-tight envelope. Support rod 46 passes through aperture 50 in endplate 42 within a ferruled breakdown shield 51. A central primary electrode assembly 47 comprises a plurality of vanes 44 which extend radially outward at the interior end of member 46 and are interdigitated between vanes 48 of an outer auxiliary electrode assembly 43 extending radially inward from sidewall 40. Radial vanes 44 and 48 are thin, define a plurality of electrically-parallel gaps therebetween, and are substantially perpendicular, in common, to a transverse plane (not shown). A metallic primary contact ring 61 rests in electrical and mechanical contact with the inner surface of lower metallic endplate 42, and is electrically connected to auxiliary electrode assembly 43.

Figure 4:
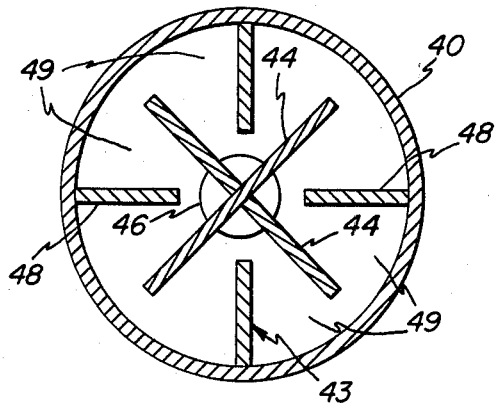
FIG. 4 is a cross-sectional view taken along line 4—4 of FIG. 3, illustrating the interleaved relationship of the arc-electrode assemblies.

Electrode assembly 43 is illustrated in greater detail in the cross-sectional view of FIG. 4, and comprises a hollow cylindrical member 40 and a plurality of inwardly-extending radial vanes 48 physically and electrically connected thereto. Since vanes 48 and 44 are substantially perpendicular, in common, to a transverse plane (e.g., the plane of the illustration), the individual inwardly-extending vanes 48 and the individual outwardly-extending vanes 44 define a plurality of electrically-parallel breakdown gaps 49 therebetween. Each of gaps 49 is substantially identical, dimensionally, to each of the others.

Vanes 48 of arc-electrode assembly 43 extend longitudinally for substantially the entire length of the discharge space within the evacuated envelope shown in FIG. 3. Vanes 44 of arc-electrode assembly 47 are somewhat shorter, as is consistent with the necessity of maintaining the separation between assembly 47 and endplates 41 and 42 of sufficient length to prevent spurious arcing, while permitting longitudinal movement of assembly 47, since the endplates are at the same electrical potential as arc-electrode assembly 43. Vanes 44 and 48 are sufficiently thin to allow formation of a large number of parallel primary breakdown gaps, none of which is overloaded by extreme current densities, in a relatively small volume without incurring excessive electrical resistivity.

Figure 5:
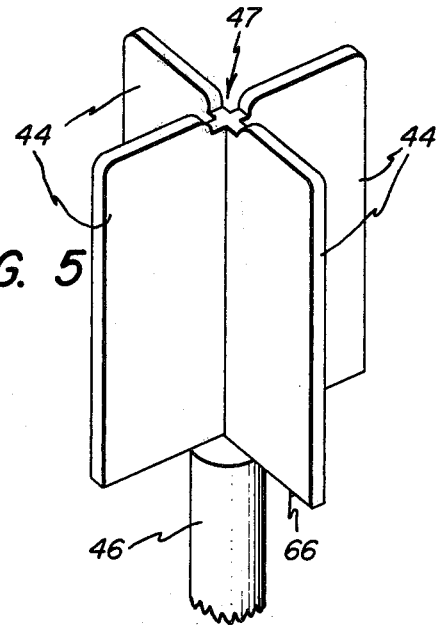
FIG. 5 is a partially cut-away, perspective view of a portion of the central electrode structure of FIG. 3.

In FIG. 5, central electrode assembly 47, illustrated in perspective, is shown to comprise a plurality of outwardly-extending, thin radial vanes 44. The vanes are fastened at their lowermost edges 66 directly to electrode support member 46.

For normal operation, the two primary contacts comprising contact ring 61 and lowermost edges 66 of radial vanes 44 are brought into electrical circuit-making position by a downward movement applied to electrode support member 46 such that, at the end of the downward stroke, the lower edges of radial vanes 44 impinge upon, and make electrical contact with, annular contact ring 61. A load circuit to be switched is connected in series with a source of alternating voltage 65 across the lower end of electrode support member 46 and lower endplate 42.

To interrupt current through the vacuum switch, electrode support member 46 is moved longitudinally upward, as permitted by bellows 58, separating edges 66 of vanes 44 from the upper surface of contact ring 61. A plurality of arcs are thereby struck between each of vanes 44 and the contact ring. Since the path of current through support member 46, electrodes 44, the arc, contact ring 61 and lower endplate 42 constitutes a loop, magnetic flux concentrates at the center of the loop, urging the arc upwardly between the vanes of the inwardly-extending outer electrode assembly and the outwardly-extending inner electrode assembly, thus rendering the entire vane surfaces available as contact surfaces for the arcs.

Once the discharge is dispersed between electrode assemblies 47 and 43, no high current density electrode spots (e.g., destructive anode spots) are formed and the entire interior of the envelope within the arcing area is filled with a gaseous plasma conducting electrically between the outer and inner electrode assemblies. Current continues to flow until occurrence of the first current zero, at which time the arc is extinguished and the vaporized metals, which constitute the arc conduction carriers, evaporate to the cold walls where they condense. The high dielectric strength of the vacuum is thus restored, holding off further high but permissible voltages.

To improve operation of the device of FIGS. 3, 4 and 5 over prior devices of similar configuration, at least the outer surfaces of contact ring 61 and edges 66 of outwardly-extending vanes 44 consist essentially of a refractory metal, such as tungsten, molybdenum, or tantalum, while inwardly-extending vanes 43 are comprised of an easily vaporizable metal such as copper or iron. Use of these materials facilitates transfer of the arc away from the gap between electrodes 44 and contact ring 61 when the vacuum switch is open, causing it to burn across gaps 49 between outwardly-extending vanes 44 and inwardly-extending vanes 48 of the vacuum switch.

The foregoing describes a high current vacuum switch in which the arc is transferred quickly from the contacts to auxiliary electrodes. The vacuum switch of the invention exhibits reduced contact erosion and high hold-off voltage for an increased number of contact openings therein.

While only certain preferred features of the invention have been shown by way of illustration, many modifications and changes will occur to those skilled in the art. It is, therefore, to be understodd that the appended claims are intended to cover all such modifications and changes as fall within the true spirit of the invention.

I claim:

1. In a vacuum arc discharge device enclosed by a hermetically sealed, evacuated envelope containing a pair of longitudinally-disposed, relatively-movable unshielded contacts capable of controllably opening and closing, both contacts being exposed to high electric field intensity when separated from each other, and a pair of interdigitated, noncontacting sets of stationary auxiliary electrodes disposed about the longitudinal axis of the device for carrying the arc when the contacts are parted, each of said contacts, when parted, being separated from said auxiliary electrodes entirely by vacuum, the improvement wherein each of said contacts is faced with a refractory metal and each of said auxiliary electrodes comprises an easily-vaporizable metal.

2. The apparatus of claim 1 wherein said refractory metal consists essentially of tungsten.

3. The apparatus of claim 1 wherein said refractory metal consists essentially of molybdenum.

4. The apparatus of claim 1 wherein said refractory metal consists essentially of tantalum.

5. The apparatus of claim 1 wherein said easily vaporizable metal comprises one of the group consisting of copper and iron.

6. In a vacuum arc discharge device having a hermetically sealed, evacuated envelope containing a pair of longitudinally-disposed, relatively-movable unshielded contacts capable of controllably opening and closing, both contacts being exposed to high electric field intensity when separated from each other, and a pair of interdigitated, nonconcontacting sets of auxiliary electrodes disposed about the longitudinal axis of the device for carrying the arc when the contacts are parted, one of said contacts being integral with said auxiliary electrodes and the other of of said contacts, when parted, being separated from each of said auxiliary electrodes entirely by vacuum, the improvement wherein at least the outer surfaces of each of said contacts consist essentially of a refractory metal and each of said auxiliary electrodes comprises easily-vaporizable metal.

7. The apparatus of claim 6 wherein said refractory metal consists essentially of tungsten.

8. The apparatus of claim 6 wherein said refractory metal consists essentially of molybdenum.

9. The apparatus of claim 6 wherein said refractory metal consists essentially of tantalum.

10. The apparatus of claim 6 wherein said easily vaporizable metal comprises one of the group consisting of copper and iron.

* * * * *